US005729857A

United States Patent [19]

Martin et al.

[11] Patent Number: 5,729,857

[45] Date of Patent: Mar. 24, 1998

[54] DEVICE FOR REMOVING SNOW AND ICE FROM THE GLASS AND PAINTED SURFACES OF AN AUTOMOBILE

[76] Inventors: Patricia S. Martin; Christopher J. Martin, both of 208 Adeline Pl., Langhorne, Pa. 19047-1458

[21] Appl. No.: 730,620

[22] Filed: Oct. 21, 1996

[51] Int. Cl.[6] ..... A47L 17/06; A41D 13/08

[52] U.S. Cl. ..... 15/111; 15/160; 15/236.02; 15/227; 15/117; 2/16; 2/160; 37/230

[58] Field of Search ..... 2/16, 20, 160, 2/161.6; 37/230; 15/227, 117, 236.01, 236.02, 160, 111

[56] References Cited

U.S. PATENT DOCUMENTS

| | | | |
|---|---|---|---|
| 770,619 | 9/1904 | Waller | 2/16 |
| 2,715,990 | 8/1955 | Austin | 2/16 |
| 2,856,621 | 10/1958 | Racicot . | |
| 3,370,302 | 2/1968 | Karlyn | 2/16 |
| 4,190,902 | 3/1980 | Rhee | 2/16 |
| 4,393,520 | 7/1983 | Koch | 2/16 |
| 4,538,320 | 9/1985 | Batt . | |
| 4,748,711 | 6/1988 | Markus . | |
| 4,807,322 | 2/1989 | Littledeer . | |
| 4,942,624 | 7/1990 | Cho | 2/16 |
| 4,962,561 | 10/1990 | Hamilton . | |
| 5,218,718 | 6/1993 | Chih | 2/16 |
| 5,335,888 | 8/1994 | Thomsen | 2/16 |
| 5,369,257 | 11/1994 | Gibbon . | |
| 5,471,698 | 12/1995 | Francis | 15/236.02 |
| 5,530,967 | 7/1996 | Cielo | 2/16 |
| 5,564,122 | 10/1996 | Wagner | 2/16 |

FOREIGN PATENT DOCUMENTS

| | | | |
|---|---|---|---|
| 1374261 | 8/1964 | France | 15/227 |
| 399407 | 10/1933 | United Kingdom | 15/227 |

*Primary Examiner*—Randall Chin
*Attorney, Agent, or Firm*—LaMorte & Associates

[57] ABSTRACT

A snow removal device for rapidly removing large amounts of snow from the top surfaces of an automobile. The snow removal device includes a mitt element that receives a person's hand and a portion of the arm to a point in between the elbow and the shoulder. The mitt element is affixed to the rear surface of a plow structure, wherein the mitt element retains the hand so that the palm of the hand faces the rear surface of the plow structure. The mitt element and the plow structure combine to retain a person's arm in a manner that prevents the arm from bending at the elbow. The plow structure has a substantially planar front surface that displaces snow as it moves across the top surfaces of an automobile. The bottom of the plow structure is configured so that is can conform to the changing contours of the automobile without scratching any finished surface that the plow structure may encounter.

12 Claims, 5 Drawing Sheets

DEVICE FOR REMOVING SNOW AND ICE FROM THE GLASS AND PAINTED SURFACES OF AN AUTOMOBILE

BACKGROUND OF THE INVENTION

1. Field of the Invention

The present invention relates in general to snow removal devices that are used to remove snow from an automobile after a snow storm. More particularly, the present invention relates to snow removal devices for automobiles that are worn on the hand and arm.

2. Description of the Prior Art

The exterior of an automobile is comprised of many different types of surfaces. Some surfaces of an automobile, such as the window glass, are highly scratch resistant. However other surfaces on the automobile, such as painted metal, plated metal and plastic, are very susceptible to scratching. When it snows, both the scratch resistant surfaces and scratch susceptible surfaces of an automobile often become covered with snow. As a result, the snow must be removed from the automobile in a manner that does not damage any of the underlying surfaces, regardless to their scratch susceptibility.

The prior art is replete with devices for removing snow and ice from an automobile. However, such devices are often designed to remove snow and ice from only one surface of the automobile. One of the most common prior art snow removal devices is an ice scraper having a protruding blade. Such prior art devices are exemplified by U.S. Pat. No. 4,748,711 to Markus, entitled ICE/SNOW SCRAPING SYSTEM; U.S. Pat. No. 4,538,320 to Batt, entitled SCRAPER WITH MITT; and U.S. Pat. No. 4,538,320 to Batt entitled SCRAPER WITH MITT. Each of these prior art scrapers contains a plastic blade that is designed to remove snow and ice from the scratch resistant glass window surfaces of an automobile. However, such prior art devices can not be used to remove snow and ice from the other surfaces of the automobile because hard plastic blades can scratch painted metal, plated metal and other scratch susceptible surfaces.

After a large snow fall, the snow must often be removed from many surfaces of an automobile other than the windows. For instance, if the snow is not removed from the hood of the automobile, the snow may blow against the windshield when the automobile is driven, thereby blinding the driver. Similarly, if the snow is not removed from the roof of an automobile, then the snow can fall off of the roof covering the rear window of the automobile. In certain situations, snow and ice that have not been removed from an automobile may fly off of the automobile while the automobile is being driven, thereby creating a danger to other automobiles on the road.

After a snow storm, often people remove snow from many surfaces of their automobile with a common floor broom. However, the bristles of a floor broom are hard and the broom can easily scratch many surfaces of the automobile if it is not used carefully. Another common technique used to remove snow from the top of an automobile is to pass a person's arm over the snow covered surfaces of the automobile. Besides the scratching hazard from zippers, buttons and the like, such a prior art technique is not preferred because the clothes and hand of the driver tend to become wet and cold.

Recognizing the need, devices have been developed in the prior art to assist a driver in removing snow from all surfaces of an automobile without damaging the surface finish on the automobile and without requiring the driver to get wet. Such prior art devices are exemplified by U.S. Pat. No. 2,856,621 to Racicot, entitled SCRAPER AND SQUEEGEE DEVICE FOR CLEARING WINDOWS OF SNOW AND ICE. In the Racicot patent, a long stick is provided. At one end of the stick is a conventional hard blade scraper. At the opposite end of the stick is a broom with soft bristles. The scraper end of the stick is used to remove snow from glass windows while the broom end is used to remove snow from the other scratch susceptible surfaces. A problem associated with snow removal devices like that of the Racicot patent is that since the broom bristles are made very soft, the broom end of the device does not displace much snow as it is wiped across the surface of the automobile. As a result, it takes a very long time to remove snow from an automobile with such a prior art device. Furthermore, if the snow is wet or is packed, then the bristles are incapable of displacing the snow, thereby making such a device ineffective. The driver of the automobile must then resort to using his/her hand to remove the snow.

It is therefore an object of the present invention to provide a snow removal device that is capable of rapidly removing large amounts of wet or dry snow from a surface of an automobile without causing damage to the finish of the surface under the snow.

It is a further object of the present invention to provide a snow removal device capable of removing snow and ice from both the glass and painted surfaces of an automobile.

These objectives are met by the present invention as described and claimed below.

SUMMARY OF THE INVENTION

The present invention is a snow removal device for rapidly removing large amounts of snow from the top surfaces of an automobile. The snow removal device includes a mitt element that receives a person's hand and a portion of the arm to a point in between the elbow and the shoulder. The mitt element is water proof and insulated, thereby protecting the hand and arm from becoming either wet or cold when the mitt element contacts snow. The mitt element is affixed to the rear surface of a plow structure, wherein the mitt element retains the hand so that the palm of the hand faces the rear surface of the plow structure. The mitt element and the plow structure combine to retain a person's arm in a manner that prevents the arm from bending at the elbow.

The plow structure has a substantially planar front surface that displaces snow as it moves across the top surfaces of an automobile. The bottom of the plow structure is configured so that is can conform to the changing contours of the automobile without scratching any finished surface that the plow structure may encounter. The front surface of the plow structure has a length of between eighteen inches and thirty inches and a height of between six inches and fifteen inches. As such, the snow removal device is capable of displacing a large volume of snow from an automobile in just one pass.

BRIEF DESCRIPTION OF THE DRAWINGS

For a better understanding of the present invention, reference is made to the following description of two exemplary embodiments thereof, considered in conjunction with the accompanying drawings, in which.

DETAILED DESCRIPTION OF THE PRESENT INVENTION

Figure 1:
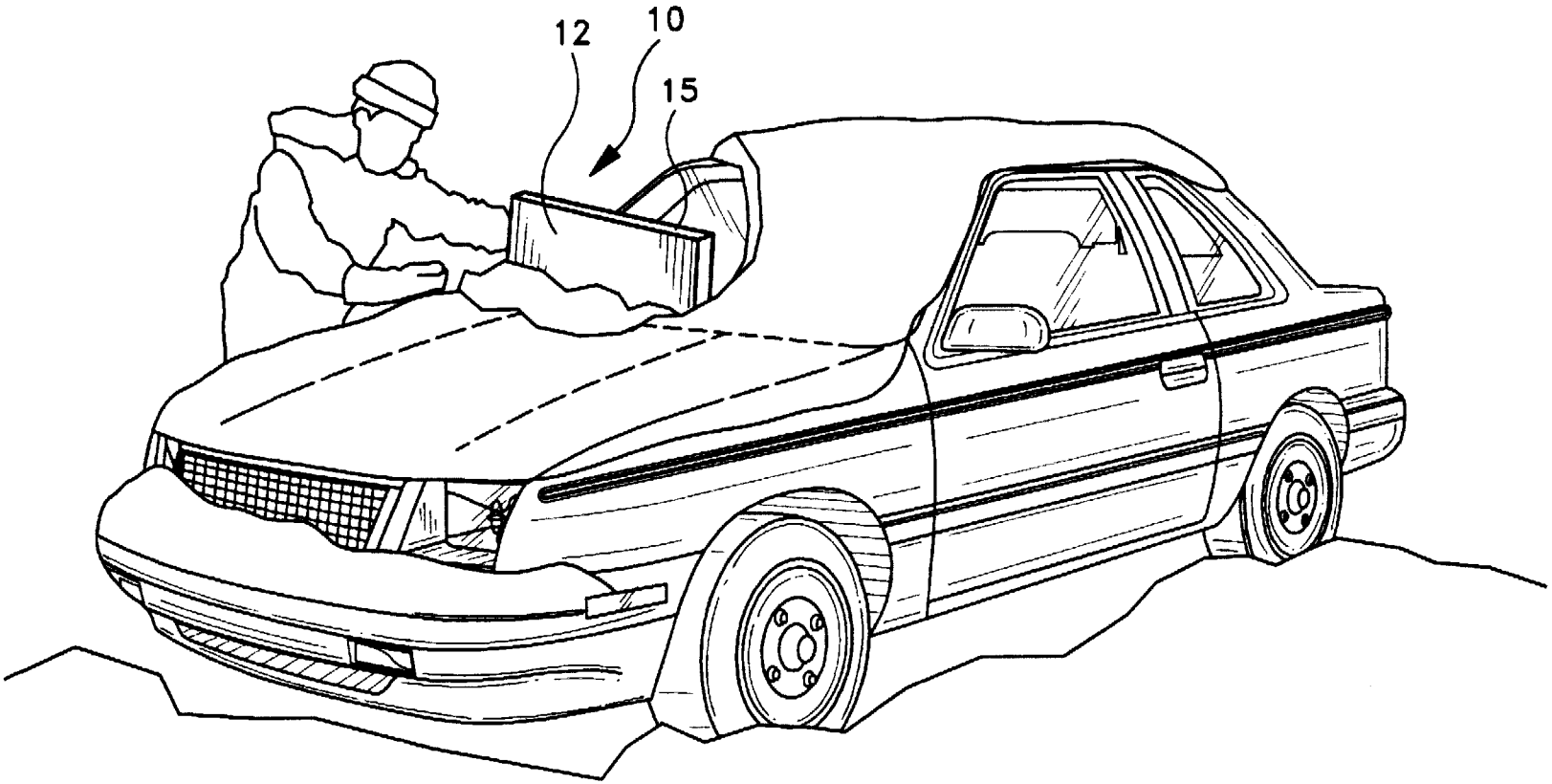
FIG. 1 is a perspective view of one preferred embodiment of the present invention snow removal device shown in conjunction with a snow covered automobile to illustrate the intended method of use for the present invention.

Referring to FIG. 1, an exemplary embodiment of a snow removal device 10 is shown in accordance with the present invention. The snow removal device 10 contains a plow structure 15 that is worn on the arm, wherein the plow structure 15 extends from a point near the finger tips to a point in between the elbow and shoulder. The snow removal device 10 protects the arm, thereby preventing the arm from becoming either wet or cold when the snow removal device 10 is in contact with snow. The plow structure 15 of the snow removal device 10 has a planar front surface 12. As a result, if a person were to place the snow removal device 10 on his/her arm and that person were to move his/her arm across the surface of an automobile, then the flat planar surface 12 of the plow structure 15 would displace the snow and push the snow off of the automobile.

Figure 2:
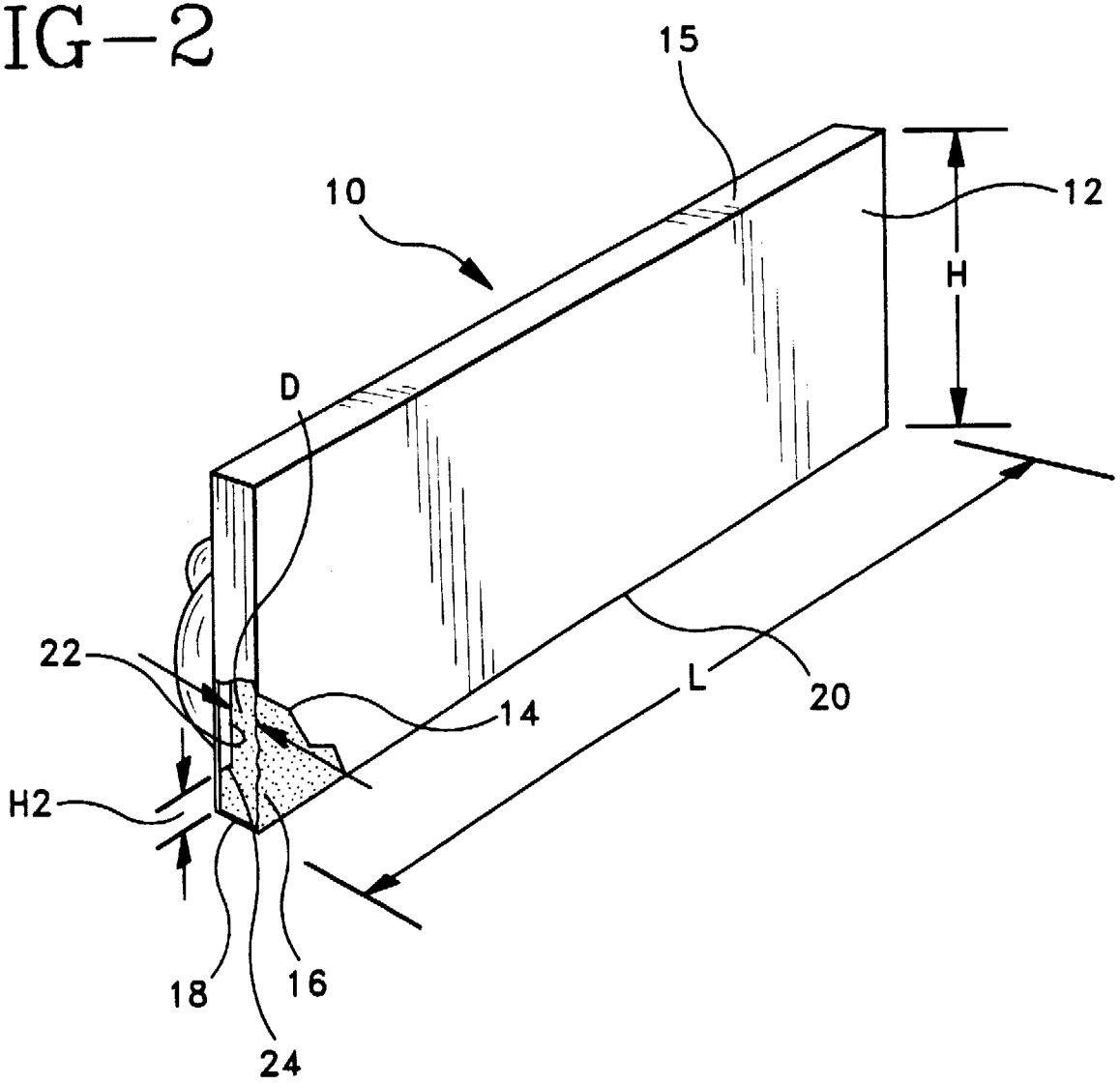
FIG. 2 a partially fragmented front perspective view of the exemplary embodiment of the present invention snow removal device previously shown in FIG. 1.

Referring to FIG. 2, it can be seen that the plow structure 15 of the snow removal device 10 is constructed of a water impervious outer material 14 that is pulled over a volume of padding material 16. As a result, the planar front surface 12 of the plow structure 15 is soft and readily deforms in response to any area of concentrated force that may be applied to the planar front surface 12. As is shown, the padding material 16 and its covering of water impervious outer material 14 defines the bottom surface 18 of the plow structure 15. When not in use, the bottom surface 18 of the plow structure 15 is planar, thereby creating a straight edge 20 at the corner where the planar bottom surface 18 intersects the planar front surface 12. The padding material 16 is preferably an elastomeric foam or similar material that is rigid enough to displace wet snow yet is soft enough not to cause the water impervious outer material 14 to mark the painted metal finish of an automobile.

It will be understood that most surfaces on an automobile are not flat. Rather, the surfaces of an automobile that collect snow, (i.e. the roof, hood windshield, etc.) tend to be contoured surfaces. As the planar bottom surface 18 of the plow structure 15 is placed across a contoured surface of an automobile, the bottom surface 18 yields and generally conforms to the contoured surface of the underlying automobile. As a result, the straight edge 20 at the front corner of the bottom surface 18 also generally conforms to the contoured surface of the underlying automobile. As the planar front surface 12 of the plow structure 15 is pulled across a surface of an automobile, the contours of the automobile under the snow removal device 10 change. The padding material 16 supporting the bottom surface 18 of the plow structure 15 enable the bottom surface 18 to immediately change shape and conform to the underlying surface. As a result, the straight edge 20 at the bottom of the planar front surface 12 lays in general conformity to the underlying automobile surface as the snow removal device 10 moves across a section of the automobile's surface. Since the bottom straight edge 20 of the planar front surface 12 lays against the surface of the automobile, snow across nearly the entire length of the plow structure 15 is displaced. As a result, the automobile is wiped near completely clean in the path travelled by the plow structure 15 after only one pass of the snow removal device 10. In a preferred embodiment, the substantially planar front surface 12 of the plow structure 15 has a length L of between eighteen inches and thirty inches. The height H of the substantially planar front surface 12 is preferably between six inches and fifteen inches. As a result, the area of the substantially planar front surface 12 is between 108 square inches and 450 square inches, thereby enabling the snow removal device 10 to displace a large volume of snow in a single pass.

As the plow structure 15 passes along a surface of an automobile, the displaced snow accumulates in front of its planar front surface 12. To prevent the snow from causing the planar front surface 12 from deforming significantly out of the vertical plane, an optional support element 22 may be contained within the plow structure 15. The support element 22 is preferably a rigid planar element such as a plank of wood, plywood, reinforced cardboard, plastic or like material. The support element 22 extends across the entire length L of the snow removal device 10. However, the support element 22 does not extend downward to the bottom surface 18 within the plow structure 15. As a result, a height H2 of padding material 16 separates the bottom edge 24 of the support element 22 from the bottom surface 18 of the plow structure 15. This clearance enables the bottom surface 18 of the plow structure 15 to deform to the contours of an underlying automobile surface without being limited by the presence of the support element 22.

The support element 22 is positioned a distance D behind the planar front surface 12. As such, the padding material 16 behind the planar front surface 12 is free to deform, yet the support element 22 retains the planar front surface 12 in its generally vertical plane.

As has been described, the planar front surface 12 has a length L that is preferably between eighteen inches and thirty inches. At this length, the plow structure 15 extends along a person's arm to a point beyond the elbow. Furthermore, at such a length range the plow structure 15 is capable of reaching far across a surface of an automobile, thereby enabling snow to be efficiently displaced with only a minimal number of passes. Additionally, since the planar front surface 12 also has a height H that is preferably between six inches and fifteen inches, the plow structure 15 is able to displace snow at least as deep as the height H of the planar front surface 12 in only a single pass.

Figure 3:
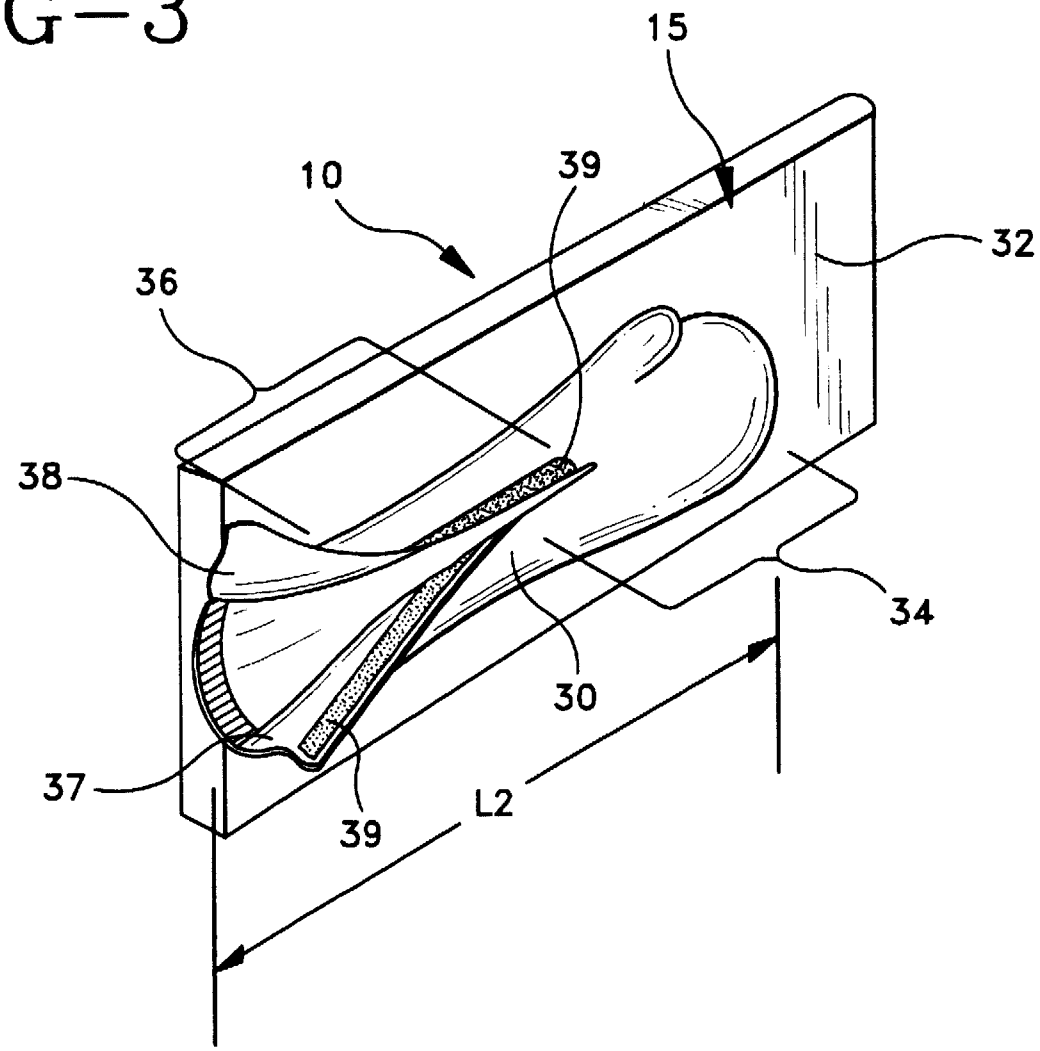
FIG. 3 is a rear perspective view of the exemplary embodiment of the present invention snow removal device previously shown in FIG. 1 and FIG. 2.

Referring to FIG. 3, it can be seen that a mitt element 30 is affixed to the rear surface 32 of the plow structure 15. The mitt element 30 is configured to contain a person's hand and arm in a manner so that the palm of the hand faces the rear surface 32 of the plow structure 15. The mitt element 30 is made of water impermeable material and contains a hand region 34 and an arm region 36. The hand region 34 of the mitt element 30 is preferably insulated in order to provide warmth to the hand when the snow removal device 10 is in use. However, the use of insulation is not required. The mitt element 30 has an overall length L2 that is between eighteen inches and thirty inches. At such lengths, it will be understood that when a person places his/her hand into the mitt element 30, the arm region 36 of the mitt element 30 will extend past the person's elbow to a point in between that person's elbow and shoulder. Since the mitt element 30 is affixed to the plow structure 15 along most of its length, it will be understood that once a hand and arm is placed within the mitt element 30, the arm region 36 of the mitt element 30 will prevent the arm from bending at the elbow. As a result, the snow removal device 10 keeps the arm straight which promotes the proper use of the device.

As can be seen from FIG. 3, the arm region 36 of the mitt element 30 opens to enable easy application of the mitt element 30 over the arm. In most applications, the mitt element 30 can be placed over a person's arm that is already covered with clothing and a winter coat. As a result, the opening formed within the arm region 36 of the mitt element 30 is very large to accommodate the added girth created by the clothing and coat. In the shown embodiment, the opening to the arm region 36 of the mitt element 30 defined by two opposing flaps 37, 38. Strips of hook and loop fastening material 39 are disposed on the two opposing flaps 37, 38. As a result, the opposing flaps 37, 38 can be selectively closed together at numerous different positions. Consequently, the arm region 36 can be snugly closed around a variety of arms having different diameters.

Figure 4:
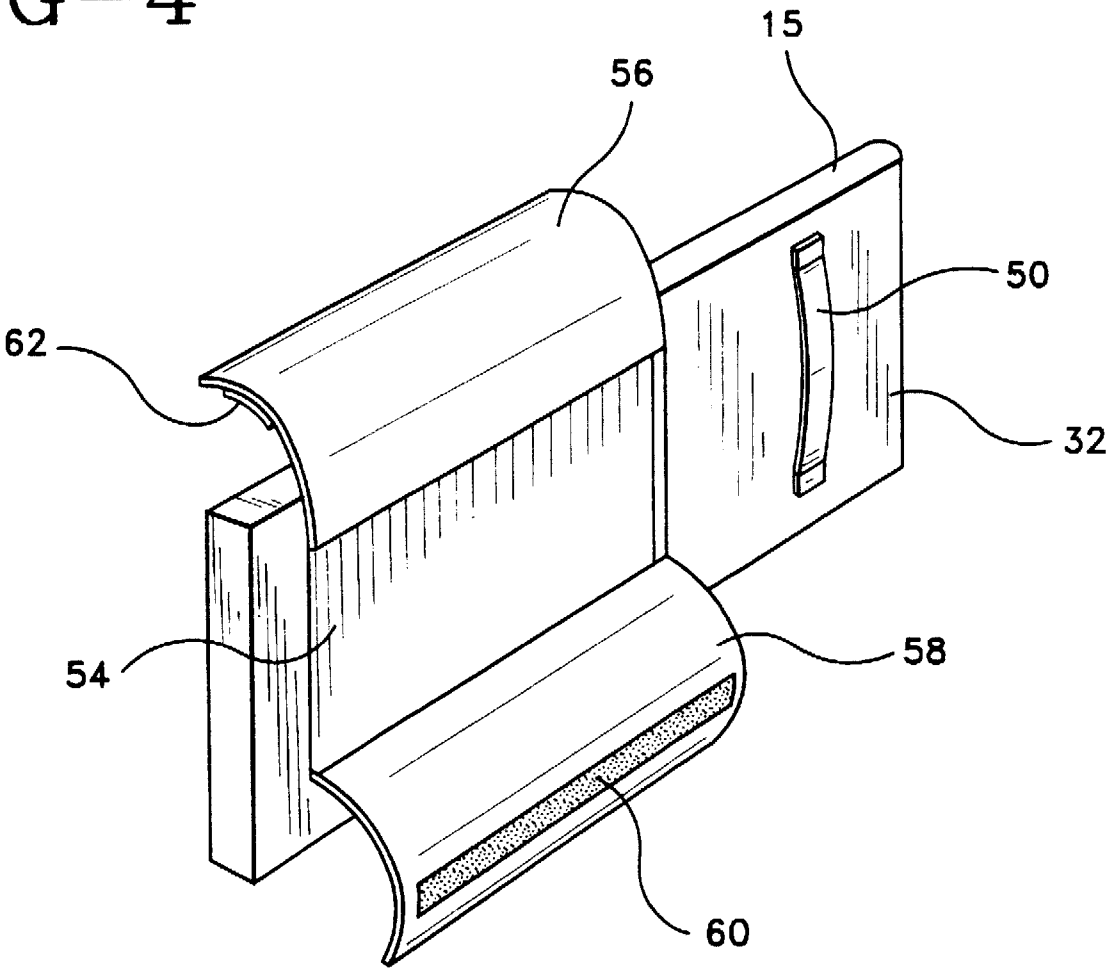
FIG. 4 is a rear perspective view of an alternate embodiment of the present invention snow removal device.

Referring to FIG. 4, an alternate embodiment is shown that does not contain a mitt element. In the shown embodiment, a strap 50 is coupled to the rear surface 32 of the plow structure 15. The strap 50 is sized so that a person wearing winter gloves can pass his/her hand under the strap 50, wherein the strap 50 biases the person's hand against the rear surface 32 of the plow structure 15. In the shown embodiment, an arm engagement structure 54 is provided. The arm engagement structure 54 contains two opposing flaps 56, 58. Strips of hook and loop fastening material 60, 62 are disposed on the two opposing flaps 56, 58. As a result, the opposing flaps 56, 58 can be selectively closed together at numerous different positions. Consequently, the arm engagement structure 54 can be snugly closed around a variety of arms having different diameters. The arm engagement structure 54 extends past the person's elbow to a point in between that person's elbow and shoulder. Since the arm engagement structure 54 is affixed to the plow structure 15 along most of its length, it will be understood that once an arm is placed within the arm engagement structure 54, the arm engagement structure 54 will prevent the arm from bending at the elbow. As a result, the snow removal device keeps the arm straight which promotes the proper use of the device.

Figure 5:
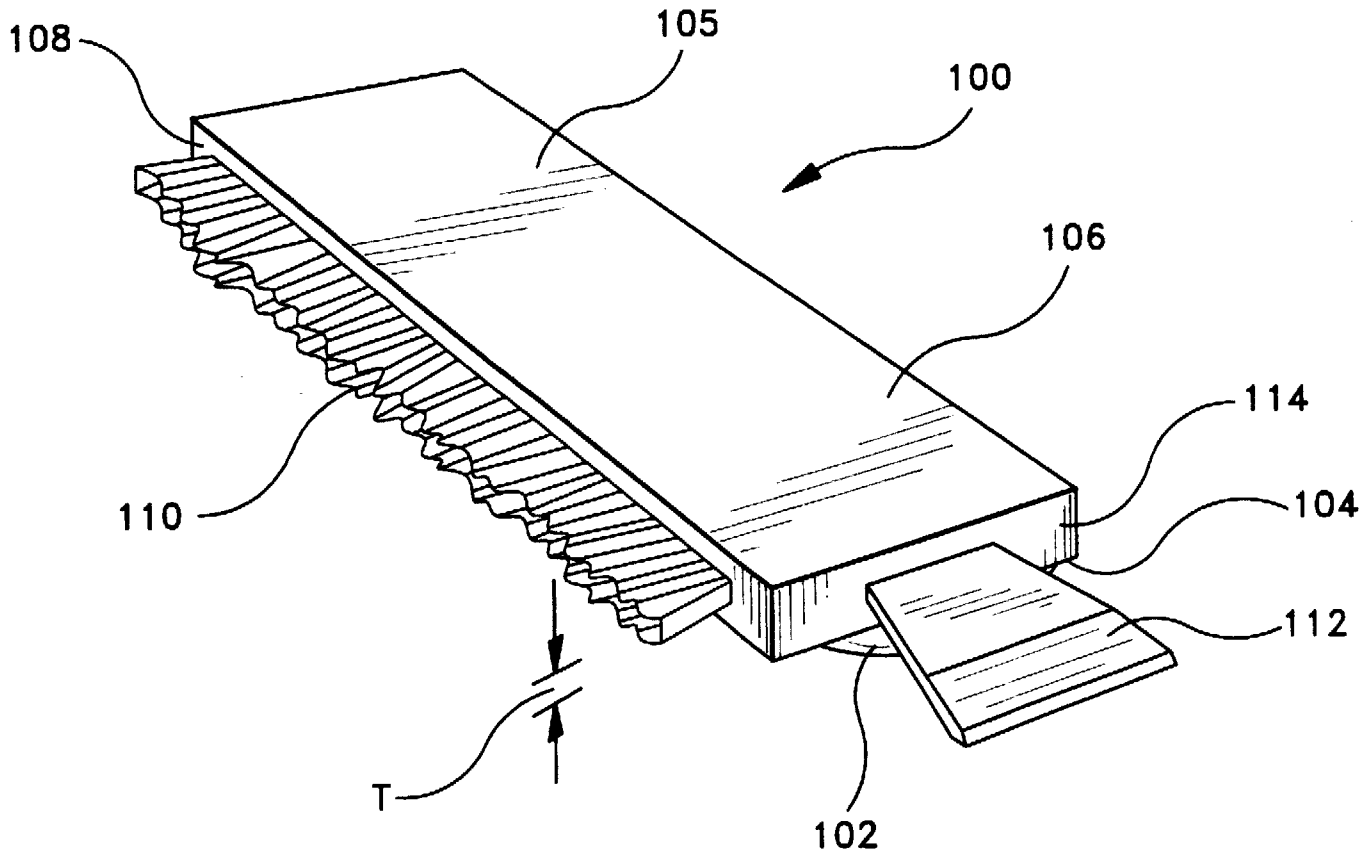
FIG. 5 is a perspective view of a second alternate embodiment of a snow removal device in accordance with the present invention.

Referring to FIG. 5, an alternate embodiment of a snow removal device 100 is shown. In this embodiment, a mitt element 102 is affixed to the rear surface 104 of a plow structure 106. The plow structure 102 in this embodiment is a rigid planar element, such as a molded plank of plastic, that has a planar front surface 105. No padding material is present. A line of bristles 110 extends downwardly from the bottom surface 108 of the plow structure 106. The line of bristles 110 serves the same purpose as did the padding material in the previous embodiment of FIGS. 1, 2 and 3. When the plow structure 106 is placed across a contoured surface of an automobile, the bristles 110 that extend from the plow structure 106 yield and partially conform to the contoured surface of the underlying automobile. As the planar front surface 105 of the plow structure 106 is pulled across a surface of an automobile, the contours of the automobile under the snow removal device 100 change. The line of bristles 110 immediately change shape and conform to the underlying surface. As a result, the line of bristles 110 lays in general conformity to the underlying automobile surface as the snow removal device 100 moves across a section of the automobile's surface. Since the line of bristles 110 lays against the surface of the automobile, snow across nearly the entire length of the plow structure 106 is displaced. As a result, the automobile is wiped near completely clean in the path travelled by the plow structure 106 after only one pass of the snow removal device 100.

The bristles 110 are soft enough not to scratch the painted finish of an automobile. However, the bristles 100 are arranged in a thickness T that provides the bristles with enough rigidity to displace wet snow.

The embodiment of FIG. 5 also includes an optional ice scraper 112. The ice scraper 112 is a plastic blade that extends forward from the front surface 114 of the plow structure 106. The ice scraper 112 does not extend to the bottom edge 108 of the plow structure 106. As such, the blade of the ice scraper 112 does not contact the automobile when the line of bristles 110 is brought into contact with the automobile. Rather, the ice scraper 112 is used solely to remove ice frozen to the hard glass surfaces of the automobile, after the excess snow has been removed by the plow structure 106.

It will be understood that the embodiments of the present invention snow removal device illustrated and described above are merely exemplary and many variations and modifications can be made by using functionally equivalent components and/or alternate embodiments. All such variations and modifications are intended to be included within the scope of the invention as defined by the appended claims.

What is claimed is:

1. A snow removal device, comprising:

an arm engagement element for receiving at least a portion of a user's arm, said arm engagement element having a first side wherein said arm engagement element retains the arm in an orientation so that a palmward side of the user's hand and arm faces said first side of said arm engagement element, said arm engagement element further including a mitt and a selectively openable seam that extends across at least part of said arm engagement element, said selectively openable seam having a first flap and a second flap and areas of hook and loop fasteners disposed on opposing sections of said first flap and said second flap;

a structure having a rear surface and a substantially planar front surface, wherein said first side of said arm engagement element is affixed to said rear surface and said substantially planar front surface has a length of between eighteen inches and thirty inches and a height of between six inches and fifteen inches.

2. The device according to claim 1, wherein said structure has a bottom surface disposed between said rear surface and said substantially planar front surface, wherein bottom surface is elastically deformable.

3. The device according to claim 2, wherein said bottom surface includes a piece of material covering an elastically deformable padding material.

4. The device according to claim 2, wherein said substantially planar front surface is a piece of material positioned over a substantially planar support of padding material.

5. The device according to claim 1, wherein said structure includes elastically deformable padding material and a water impermeable exterior covering that covers said padding material.

6. The device according to claim 1, wherein said substantially planar front surface is covered in water impermeable material and said structure further includes a rigid support element and padding disposed between said rigid support and said water impermeable material.

7. The device according to claim 1, wherein said structure has a bottom surface disposed between said rear surface and said substantially planar front surface, and said device further includes a line of bristles extending downwardly from said bottom surface.

8. The device according to claim 1, wherein said mitt element is affixed to said rear surface of said structure.

9. The device according to claim 1, wherein said planar front surface extends between a first end and a second end and said device further includes an ice scraper blade extending from said first end.

10. A snow removal device, comprising:

a structure having a rear surface, a substantially planar front surface, a rigid support element disposed in between said rear surface and said substantially planar front surface, a water impermeable material covering said substantially planar front surface and padding disposed between said rigid support and said water impermeable material;

an arm engagement element affixed to said rear surface of said structure, wherein said arm engagement element is adapted to retain a portion of an arm between the elbow and the shoulder in an orientation whereby a palmward side of the hand faces said rear surface of said substantially planar front surface and said arm engagement element prevents the arm from bending at the elbow.

11. The device according to claim 10, wherein said substantially planar front surface has a length of between eighteen inches and thirty inches and a height of between six inches and fifteen inches.

12. The device according to claim 10, wherein said padding is elastically deformable.

* * * * *